US006378660B1

(12) United States Patent
Adifon et al.

(10) Patent No.: US 6,378,660 B1
(45) Date of Patent: Apr. 30, 2002

(54) HYDRAULIC ELEVATOR WITHOUT A MACHINEROOM

(75) Inventors: Leandre Adifon, Farmington, CT (US); Carlo Varisco, Cernusco sul Naviglio (IT)

(73) Assignee: Otis Elevator Company, Farmington, CT (US)

( * ) Notice: Subject to any disclaimer, the term of this patent is extended or adjusted under 35 U.S.C. 154(b) by 253 days.

(21) Appl. No.: 08/995,507

(22) Filed: Dec. 22, 1997

(51) Int. Cl.[7] ..... B66B 1/00; B66B 5/02

(52) U.S. Cl. ..... 187/272; 187/274; 187/275; 187/276

(58) Field of Search ..... 187/272, 274, 187/275, 276

(56) References Cited

U.S. PATENT DOCUMENTS 4,438,831 A * 3/1984 Rohanna ..... 187/276
4,830,146 A * 5/1989 Nakamura et al. ..... 187/272 X
5,014,823 A * 5/1991 Pelto-Huikko ..... 187/275

FOREIGN PATENT DOCUMENTS

| | | |
|---|---|---|
| EP | 0680921 | 5/1995 |
| JP | 02296497 | 10/1990 |
| JP | 07114228 | 5/1995 |
| SE | 332698 | 2/1971 |

* cited by examiner

*Primary Examiner*—Christopher P. Ellis
*Assistant Examiner*—Gene O. Crawford

(57) ABSTRACT

A hydraulic elevator system having a configuration without a machineroom is disclosed. The hydraulic elevator system includes a valve assembly that is separated and remotely located from the pump and fluid tank. This arrangement permits the valve assembly and an electronic controller to be located in a cabinet outside of the hoistway, and the other hydraulic components, such as a tank and pump, to be located in the hoistway.

22 Claims, 2 Drawing Sheets

HYDRAULIC ELEVATOR WITHOUT A MACHINEROOM

TECHNICAL FIELD

The present invention relates to hydraulic elevators.

BACKGROUND OF THE PRESENT INVENTION

Conventional hydraulic elevators include a hydraulically driven ram to raise an elevator car. Lowering of the car is typically accomplished by permitting fluid to exit the cylinder of the hydraulic ram and using the weight of the car to force the fluid out of the cylinder. The piston may be directly engaged with the car or may be engaged with the car via a rope fixed to the hoistway and engaged with a sheave on a yoke on the piston. The latter arrangement provides the benefit of not requiring a hole under the hoistway to receive the hydraulic cylinder.

One advantage of hydraulic elevators as compared to traction elevators is the lower cost of the installation. Another traditional advantage is that the machineroom for the hydraulic elevator may be located anywhere in the building, rather than above the hoistway as in traditional traction elevators. Even though the machineroom for a hydraulic elevator may be remotely located, it is still necessary to provide such a space in order to provide a closed and protected area for the hydraulic components: the fluid tank, the pump (typically submerged in the tank of fluid), and the valves associated with the pump and tank. In addition, the machineroom includes a controller that includes the various electrical components for the hydraulic elevator system.

The above art notwithstanding, engineers under the direction of Applicant's Assignee are working to develop improved hydraulic elevator systems that minimize the space requirements for the system.

DISCLOSURE OF THE INVENTION

According to the present invention, a hydraulic elevator system includes a valve block that is remotely located relative to the pump and fluid tank.

As a result of having the valve block separate from the pump and tank, the necessity for a machineroom is eliminated. The pump and tank may be located in the hoistway and the valve block may be located in a cabinet along with various electronic components of the hydraulic elevator system. The cabinet may be conveniently positioned adjacent to a landing so that a mechanic will have access to the valve block and electronic control without having to enter the hoistway.

According to a particular embodiment, the hydraulic elevator system includes a car and a hydraulic cylinder positioned adjacent to the travel path of the car and mounted on a support, and wherein the pump and tank are positioned underneath the support. This arrangement of the cylinder, pump and tank provides a compact configuration that minimizes the space requirements of the hoistway.

According to a further particular embodiment, the cylinder includes a sheave engaged with a rope, wherein the rope is attached to the car by a rope hitch, and wherein the rope hitch is disposed on the car in a position to avoid interference when the car is adjacent to the tank and pump. This particular embodiment provides a configuration that permits the use of a roped hydraulic elevator without a machineroom.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
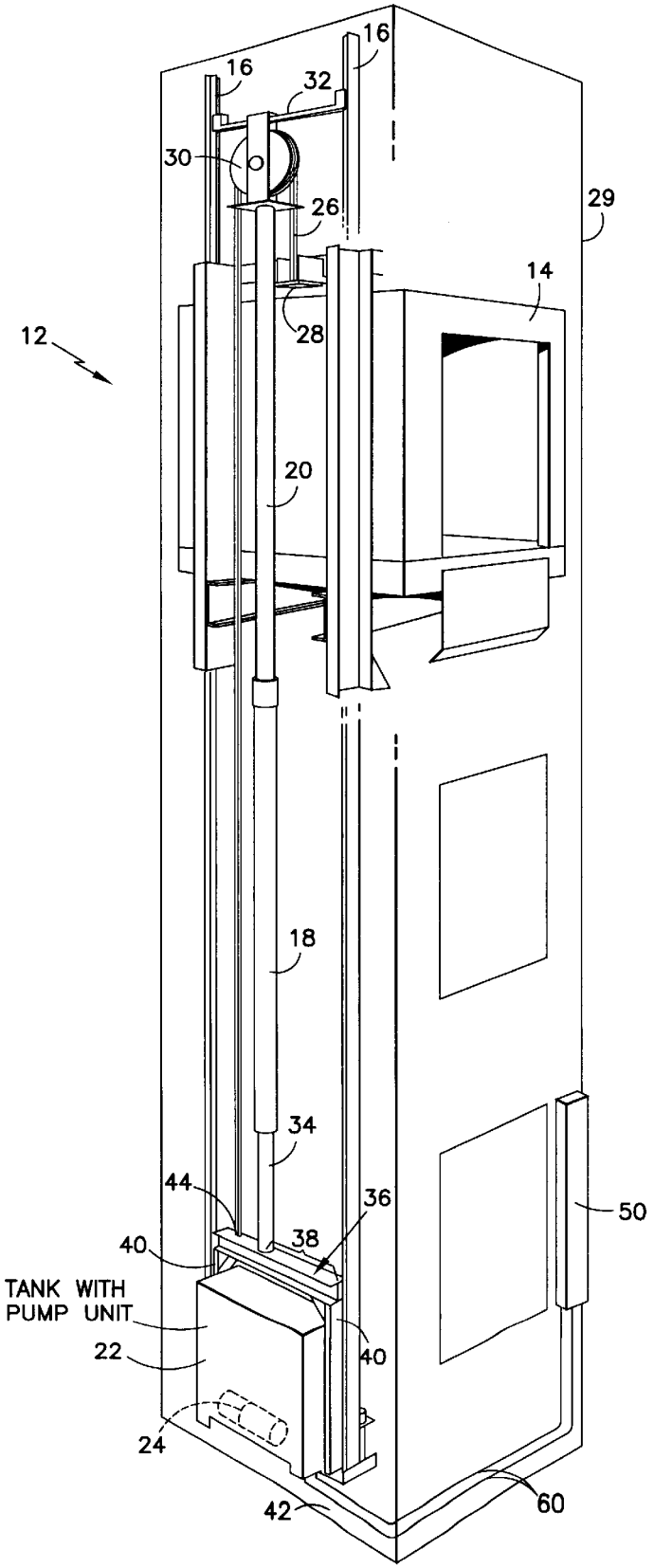
FIG. 1 is an illustration of a hydraulic elevator system according to the present invention.

Illustrated in FIG. 1 is a hydraulic elevator system 12. The hydraulic elevator system 12 includes a car 14 engaged with a pair of guide rails 16, a hydraulic cylinder 18 having a piston 20, a fluid tank 22 having a pump 24 disposed within the tank 22, and a plurality of ropes 26. The ropes 26 have one end attached to the car 14 by a rope hitch 28 and the opposite end anchored in the hoistway 29. The ropes 26 extend over a sheave 30 mounted on the upper end of the piston 20. Movement of the piston 20 is guided by a yoke 32 engaged with the pair of guide rails 16. During operation, the piston 20 moves within the cylinder 18 and causes the sheave 30 to raise and lower within the hoistway 29. Movement of the sheave 30 causes the car 14 to raise and lower in the hoistway 29 via the engagement with the ropes 26.

The cylinder 18 includes a cylinder stand 34 that is mounted on a support assembly 36 positioned between the guide rails 16. The support assembly 36 includes a horizontal support 38, formed from a conventional I-beam structure, and a pair of vertical uprights 40 that are adjacent to the pair of guide rails 16 and are supported by the bottom or pit 42 of the hoistway 29. In addition to supporting the cylinder 18, the horizontal support 38 also provides an anchor point 44 for the ropes 26. As a result of the support assembly 36, the cylinder 18 is raised above or off-set from the pit 42.

The integral tank 22 and pump 24 are disposed in the opening defined by the support assembly 36. The tank 22, which contains the fluid (typically oil) used in the hydraulic system extends to fill the space between the uprights 40 and the support 38. The pump 24 is internal to the tank 22 and submerged in the fluid. As a result of not integrating a valve block and various other valve components to the tank 22 and pump 24, the size of the tank 22 is minimized and may be proportioned to fit in the available space.

The cylinder 18, support assembly 36, guide rails 16, tank 22 and pump 24 are all positioned along one side of the travel path of the car 14. During travel through the hoistway 29, the car 14 may be adjacent to one or more of the components in the hoistway 29. In order to avoid interference between the hoistway components and the ropes 26 and rope hitch 28, the rope hitch 28 is positioned at the top of the car 14. In a typical roped hydraulic elevator, the ropes are hitched or engaged with the bottom of the car.

Figure 2:
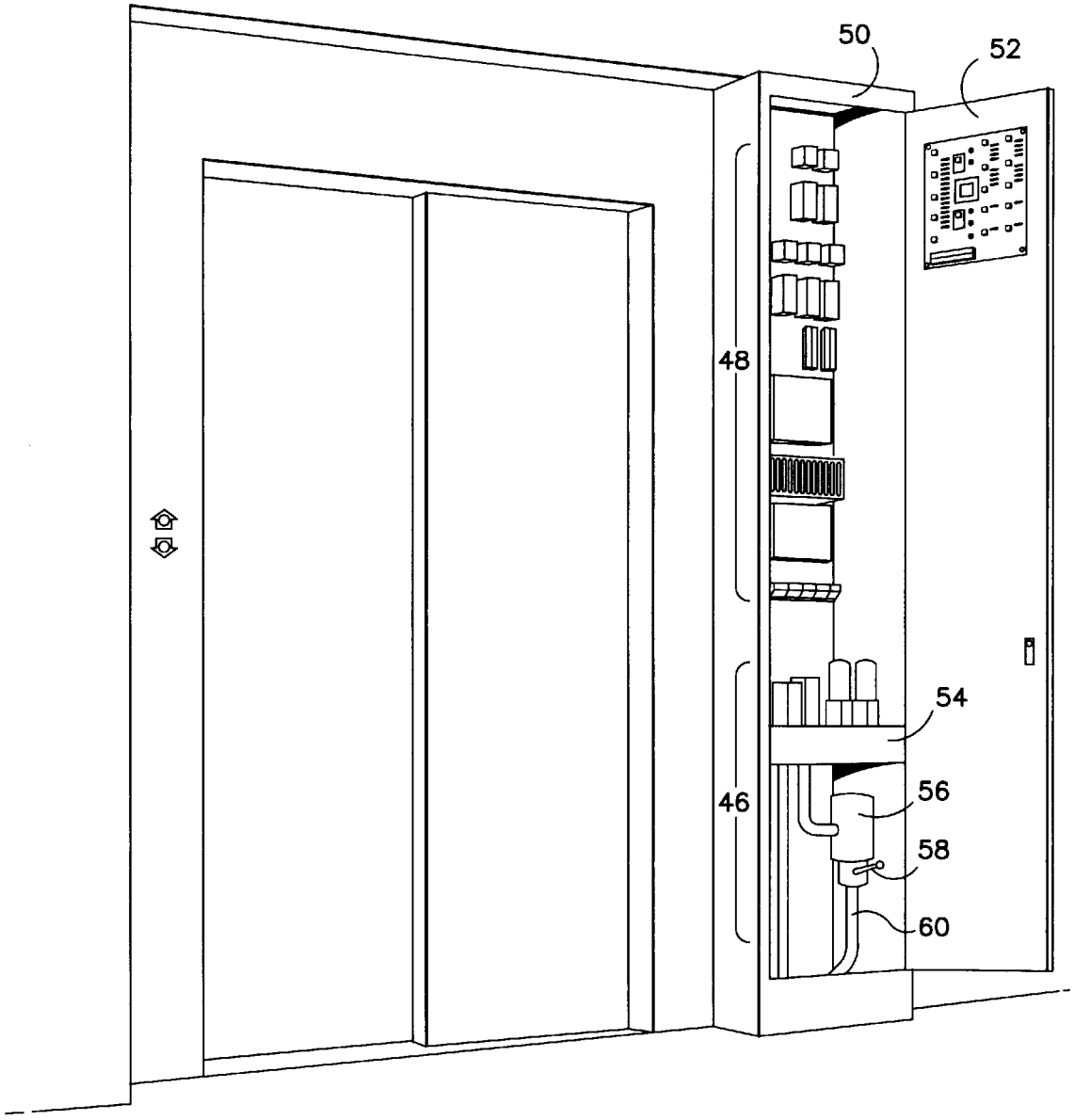
FIG. 2 is an illustration of cabinet housing a valve assembly and electronic controller.

The flow of fluid between the tank 22 and cylinder 18 is controlled by a control valve assembly 46 and an electronic controller 48. These devices 46,48, as shown in FIG. 2, are located in a cabinet 50 positioned adjacent to one of the landings of the hoistway 29. Access to the control valve assembly 46 and controller 48 is through a locked door 52. The door 52 is locked to prevent unauthorized access to the controller 48 and the control valve assembly 46.

The electronic controller 48 is in the upper part of the cabinet 50 and the control valve assembly 46 in is the lower part of the cabinet 50. This particular arrangement takes advantage of the height of the cabinet 50, and the possibility to separate the electronic controller 48 into components that may be mounted in the cabinet 50 or on the door 52, in order to minimize the space requirements of the cabinet 50.

Although shown in FIG. 2 as being adjacent to a landing, it should be noted that the cabinet 50 may be located in other convenient locations, and, in addition, the cabinet 50 may be separated into two or more cabinets. In this configuration, the electronic controller 48 may be separated from the control valve assembly 46, if desired. Further, the controller and control valve assembly, including the valve block, may be separated into multiple modules, with each module conveniently located.

The control valve assembly 46 includes a valve block 54, a muffler 56 and a manually operable release mechanism 58. The control valve assembly 46 is in fluid communication with the tank 22 by a plurality of fluid lines 60. The valve block 54 includes various valve stems and channels that control the flow of fluid between the cylinder 18 and pump 24 using conventional valve technology. The muffler 56 regulates the fluid flow from the valve block 54 to the cylinder 18. The release mechanism 58 permits a mechanic to manually open the valves to flow fluid from the cylinder 18 and into the tank 22. The manual operation of the valves may be used during emergency operations to lower the car 14 and evacuate passengers. Although shown and described as a manually operable mechanism 58, other mechanisms may be used, such as electrically controllable actuators connected to a back-up power supply.

During operation of the hydraulic elevator system 12, passengers place car calls and hall calls that are registered through the electronic controller 48. The electronic controller 48 signals the pump 24 and valve block 54 to operate in the desired manner to transfer fluid to or from the cylinder 18 and to raise or lower the car 14. If service of the hydraulic elevator system 12 is required, a mechanic may get access to both the controller 48 and the valve block 54 by unlocking the cabinet 50. Locating the cabinet 50 with the controller 48 and valve block 54 near a landing facilitates the maintenance of the hydraulic elevator system 12. In addition, in the event of an emergency, the mechanic may get access to the manual release mechanism 58 through the cabinet 50.

Although the invention has been shown and described with respect to exemplary embodiments thereof, it should be understood by those skilled in the art that various changes, omissions, and additions may be made thereto, without departing from the spirit and scope of the invention.

What is claimed is:

1. A hydraulic elevator system for moving a car within a hoistway, the hydraulic elevator system including a hydraulic cylinder, a fluid tank, a pump for moving fluid between the tank and cylinder, wherein the tank and pump are disposed in the hoistway, and a valve block that controls the flow of fluid between the tank and cylinder, wherein the valve block is disposed outside the hoistway.

2. The hydraulic elevator system according to claim 1, further including an electronic control system, and wherein the control system and valve block are split into modules that are distributed in various locations.

3. The hydraulic elevator system according to claim 1, further including a cabinet disposed adjacent to a landing of the hoistway, and wherein the valve block is located in the cabinet.

4. The hydraulic elevator system according to claim 3, wherein the cabinet further includes an electronic control system.

5. The hydraulic elevator system according to claim 1, wherein the valve block includes a release mechanism, wherein actuation of the release mechanism permits fluid to flow through the valve.

6. The hydraulic elevator system according to claim 5, wherein the release mechanism is manually operable.

7. A hydraulic elevator system for moving a car within a hoistway, the hydraulic elevator system including a hydraulic cylinder, a fluid tank, a pump for moving fluid between the tank and cylinder, wherein the tank and pump are disposed in the hoistway, and a valve block that controls the flow of fluid between the tank and cylinder, wherein the valve block is disposed outside the hoistway, wherein the cylinder is mounted on a support disposed below the cylinder, and wherein the tank and pump are positioned underneath the support and Adjacent to the travel the car.

8. The hydraulic elevator system according to claim 7, Further including a rope attached to the car by a rope hitch, wherein the hydraulic cylinder further includes a sheave engaged with the rope to drive the car through the hoistway, and wherein the rope hitch is disposed on the car in a position such that it avoids interfering with the tank and pump when the car is adjacent to the tank and pump.

9. A hydraulic elevator system for moving a car within a hoistway, the hydraulic elevator system including a hydraulic cylinder, a fluid tank, a pump for moving fluid between the tank and cylinder, wherein the tank and pump are disposed within the hoistway, wherein the transfer of fluid between the tank and cylinder causes the car to move within the hoistway, and a release mechanism, wherein actuation of the release mechanism permits fluid to be transferred between the cylinder and the tank, and wherein the release mechanism is disposed outside the hoistway.

10. The hydraulic elevator system according to claim 9, wherein the release mechanism is manually operable.

11. The hydraulic elevator system according to claim 9, further including a cabinet disposed adjacent to a landing of the hoistway, and wherein the release mechanism is located in the cabinet.

12. The hydraulic elevator system according to claim 9, further including a control valve assembly located outside the hoistway, and wherein the release mechanism is integral to the control valve assembly.

13. The hydraulic elevator system according to claim 12, wherein the control valve assembly includes a valve block that controls the flow of fluid between the tank and cylinder.

14. A hydraulic elevator system for moving a car within a hoistway, the hydraulic elevator system including a hydraulic cylinder, a fluid tank disposed within the hoistway wherein the transfer of fluid between the tank and cylinder causes the car to move within the hoistway, a pair of guide rails that guide the movement of the car, and a support assembly positioned between the guide rails and adjacent to the travel path of the car, wherein the cylinder is mounted on the support assembly, and wherein the tank is positioned underneath the support assembly and adjacent to the travel path of the car.

15. The hydraulic elevator system according to claim 14, further including a rope attached to the car by a rope hitch, wherein the hydraulic cylinder further includes a sheave engaged with the rope to drive the car through the hoistway, and wherein the rope hitch is disposed on the car in a position such that it avoids interfering with the tank and pump when the car is adjacent to the tank.

16. The hydraulic elevator system according to claim 14, further including a control valve assembly, and wherein the control valve assembly is disposed outside the hoistway.

17. The hydraulic elevator system according to claim 14, further including a pump for moving fluid between the tank and cylinder, wherein the pump is disposed within the hoistway, underneath the support and adjacent to the travel path of the car.

18. The hydraulic elevator system according to claim 14, wherein the support assembly further includes a horizontal support that extends between the guide rails and that supports the cylinder.

19. A hydraulic elevator system for moving a car within a hoistway, the hydraulic elevator system including a hydraulic cylinder, a fluid tank, a pump for moving fluid between the tank and cylinder, wherein the tank and pump are disposed in the hoistway and a control valve assembly that controls the flow of fluid between the tank and cylinder, wherein the control valve assembly is disposed outside the hoistway.

20. The hydraulic elevator system according to claim 19, wherein the control valve assembly include a valve block.

21. The hydraulic elevator system according to claim 19, wherein the control valve assembly includes a release mechanism, wherein actuation of the release mechanism permits fluid to be transferred between the cylinder and the tank.

22. A hydraulic elevator system for moving a car within a hoistway having a pit, the hydraulic elevator system including a hydraulic cylinder, a fluid tank disposed within the hoistway, wherein the transfer of fluid between the tank and cylinder causes the car to move within the hoistway, a pair of guide rails that guide the movement of the car, and a support assembly positioned between the guide rails and adjacent to the travel path of the car, the support assembly including a horizontal support that extends between the guide rails and that supports the cylinder, wherein the cylinder is mounted on the support assembly, and wherein the tank is positioned underneath the support assembly and adjacent to the travel path of the car, and wherein the support assembly further includes at least one vertical upright that extends from the horizontal support to the pit of the hoistway to off-set the cylinder from the pit.

* * * * *